US008214992B2

(12) United States Patent
Hirano

(10) Patent No.: US 8,214,992 B2
(45) Date of Patent: Jul. 10, 2012

(54) METHOD FOR MANUFACTURING GOLF CLUB HEAD

(75) Inventor: Tomoya Hirano, Kobe (JP)

(73) Assignee: SRI Sports Limited, Kobe (JP)

( * ) Notice: Subject to any disclaimer, the term of this patent is extended or adjusted under 35 U.S.C. 154(b) by 336 days.

(21) Appl. No.: 12/608,465

(22) Filed: Oct. 29, 2009

(65) Prior Publication Data

US 2010/0154196 A1 Jun. 24, 2010

(30) Foreign Application Priority Data

Dec. 19, 2008 (JP) ..... 2008-323331
Feb. 12, 2009 (JP) ..... 2009-030117

(51) Int. Cl.
*A63B 53/04* (2006.01)
*B23P 17/00* (2006.01)
*B21D 31/00* (2006.01)

(52) U.S. Cl. ..... 29/412; 29/525.14; 29/557; 473/342; 473/345; 72/366.2; 72/379.2

(58) Field of Classification Search ..... 29/412, 29/525.14, 557; 473/324, 330, 345, 342; 72/340, 341, 366.2, 379.2
See application file for complete search history.

(56) References Cited

U.S. PATENT DOCUMENTS

| | | | | |
|---|---|---|---|---|
| 6,663,501 | B2 * | 12/2003 | Chen | 473/324 |
| 6,743,118 | B1 * | 6/2004 | Soracco | 473/342 |
| 6,926,616 | B1 * | 8/2005 | Kusumoto et al. | 473/305 |
| 7,220,190 | B2 * | 5/2007 | Hirano | 473/342 |
| 7,690,098 | B2 * | 4/2010 | Chen | 29/557 |
| 2007/0105657 | A1 * | 5/2007 | Hirano | 473/345 |
| 2007/0270236 | A1 * | 11/2007 | Hirano | 473/345 |

FOREIGN PATENT DOCUMENTS

JP 10-155943 A 6/1998

* cited by examiner

*Primary Examiner* — Jermie Cozart
(74) *Attorney, Agent, or Firm* — Birch, Stewart, Kolasch & Birch, LLP

(57) ABSTRACT

A method for manufacturing a golf club head composed of a metal main body and a non-flat metal face member which are welded each other is disclosed. In order to make the non-flat metal face member, an in-process face material is cut out from a rolled metal plate having a constant thickness. And a turn-back is formed around the in-process face material by press working. Before making the press working, the region of the in-process face material corresponding to the turnback is decreased in the thickness by a cutting work.

21 Claims, 12 Drawing Sheets

E 1 section

METHOD FOR MANUFACTURING GOLF CLUB HEAD

BACKGROUND OF THE INVENTION

The present invention relates to a method for manufacturing a golf club head, more particularly to a method for manufacturing a face member having a turnback from a rolled metal plate.

There has been proposed a hollow golf club head which is, as shown in FIG. 3, composed of a metal main body having a front opening O and a non-flat face member welded thereto, wherein the face member is manufactured by forging a round bar of the metal material so as to form a turnback, therefore, the face member has a disadvantage such that the production cost is high.

SUMMARY OF THE INVENTION

It is therefore, an object of the present invention, to provide a method for manufacturing a golf club head in which the non-flat face member is formed from a rolled metal plate at low cost and at a high yield rate.

According to the present invention, a method for manufacturing a golf club head comprises:

a step of preparing a non-flat metal face member;

a step of preparing a metal head main body; and a step of welding the non-flat metal face member to the metal head main body, wherein the step of preparing said non-flat metal face member comprises:

a process (a) in which a rolled metal plate having a constant thickness is prepared;

a process (b) in which an in-process face material is cut out from the rolled metal plate after the process (a);

a process (c) in which the face member is prepared by forming the turnback by subjecting the in-process face material to a press working after the process (b);

a process (d) in which, in the outer surface of a region corresponding to the turnback (hereinafter, the "corresponding-to-turnback region"), an inclined surface inclined to the inner surface of corresponding-to-turnback region towards the peripheral edge of corresponding-to-turnback region is formed by a cutting work carried out before the process (c) in a state of the in-process face material or in a state of the rolled metal plate so that the thickness of the corresponding-to-turnback region is continuously decreased towards the peripheral edge of the corresponding-to-turnback region.

DEFINITIONS

In this specification, sizes, positions, directions and the like relating to the club head refer to those under a standard state of the club head unless otherwise noted.

Here, the standard state of the club head 1 is such that the club head is set on a horizontal plane HP so that the center line CL of the club shaft (not shown) is inclined at the lie angle (alpha) while keeping the club shaft center line CL on a vertical plane, and the club face 2 forms its loft angle with respect to the horizontal plane HP. Incidentally, in the case of the club head alone, the center line of the shaft inserting hole (h) can be used instead of the center line of the club shaft.

Sweet spot SS is the point of intersection between the club face 2 and a straight line drawn normally to the club face passing the center of gravity of the head.

Front-back direction is a direction parallel with the above-mentioned straight line projected on the horizontal plane HP.

Heel-and-toe direction is a direction parallel with the horizontal plane HP and perpendicular to the front-back direction.

Size L of the turnback 9 is a distance in the front-back direction measured from the edge (2*a*-2*d*) of the club face 2 to the rear edge of the turnback 9.

If the edge (2*a*-2*d*) of the club face 2 is unclear due to smooth change in the curvature, as shown in FIGS. 10(*a*) and 10(*b*), a virtual edge line defined based on the curvature change is used instead as follows. In each cutting plane E1, E2—including the sweet spot SS and the center of gravity of the head, a point at which the radius (r) of curvature of the profile line Lf of the face portion first becomes under 200 mm in the course from the center SS to the periphery of the club face is determined. Then, the virtual edge line is defined as a locus of the obtained points.

In the present invention, the face member is obtained by making the turnback by applying press working to the in-process face material cut out from the rolled metal plate, therefore, in comparison with the forging, the face member can be manufactured at low cost.

If a thick rolled metal plate is used in order to secure the durability of the face portion, due to the press working, crease and cracks are very liable to occur on the turnback and consequently the rejection rate of the face member is increased. On the other hand, if a thin rolled metal plate is used, the pressure molding of the turnback becomes easy and the rejection rate can be improved, but there is a possibility that the durability of the face portion becomes insufficient due to the thin main portion.

In the present invention, in a state of the rolled metal plate or in a state of the in-process face material cut out from the rolled metal plate, the corresponding-to-turnback region is cut into a specific shape. In concrete terms, the thickness of the corresponding-to-turnback region is continuously decreased towards its peripheral edge, and the inclined surface inclined to the inner surface towards the peripheral edge is formed in the outer surface of the corresponding-to-turnback region. Thereafter, by the press working, the turnback is formed.

According to the present invention, therefore, a thick rolled metal plate can be used to provide a sufficient strength and durability for the main portion of the face member. Since the corresponding-to-turnback region is cut into a specific shape, this region can be deformed easily, therefore, in the press working, the turnback can be bent backward of the head largely without causing crease and cracks. In other words, when the turnback is formed by pressure molding, a tensile stress occurs in the outer surface of the corresponding-to-turnback region and a compressive stress occurs in the inner surface, therefore, cracks are especially liable to occur in the outer surface where a tensile stress occurs. Further, as the above-mentioned tensile stress is large, the accuracy of the shape and dimension after bending operation is liable to reduce.

In the present invention, the corresponding-to-turnback region continuously decreases in the thickness towards the peripheral edge and the inclined surface which inclines to the inner surface towards the peripheral edge is formed in the outer surface thereof. Such corresponding-to-turnback region decreases the tensile stress occurring in the outer surface during pressure molding, therefore, cracks which tend to occur in the outer surface can be effectively prevented, and the working accuracy and yield rate can be improved.

Accordingly, in the present invention, the non-flat face member can be manufactured from the rolled metal plate at a high yield rate, and as a result, the golf club head can be manufactured at low cost.

BRIEF DESCRIPTION OF THE DRAWINGS

FIG. 4(*b*) is a cross sectional view of the face member taken along line B-B in FIG. 2.

FIG. 6(*b*) is a plan view for explaining a multidirectional rolling.

FIG. 12(*b*) is a cross sectional view taken along line B-B in FIG. 13.

FIG. 12(*c*) is a partial cross sectional view of the in-process face material cut out.

DESCRIPTION OF THE PREFERRED EMBODIMENTS

Figure 1:
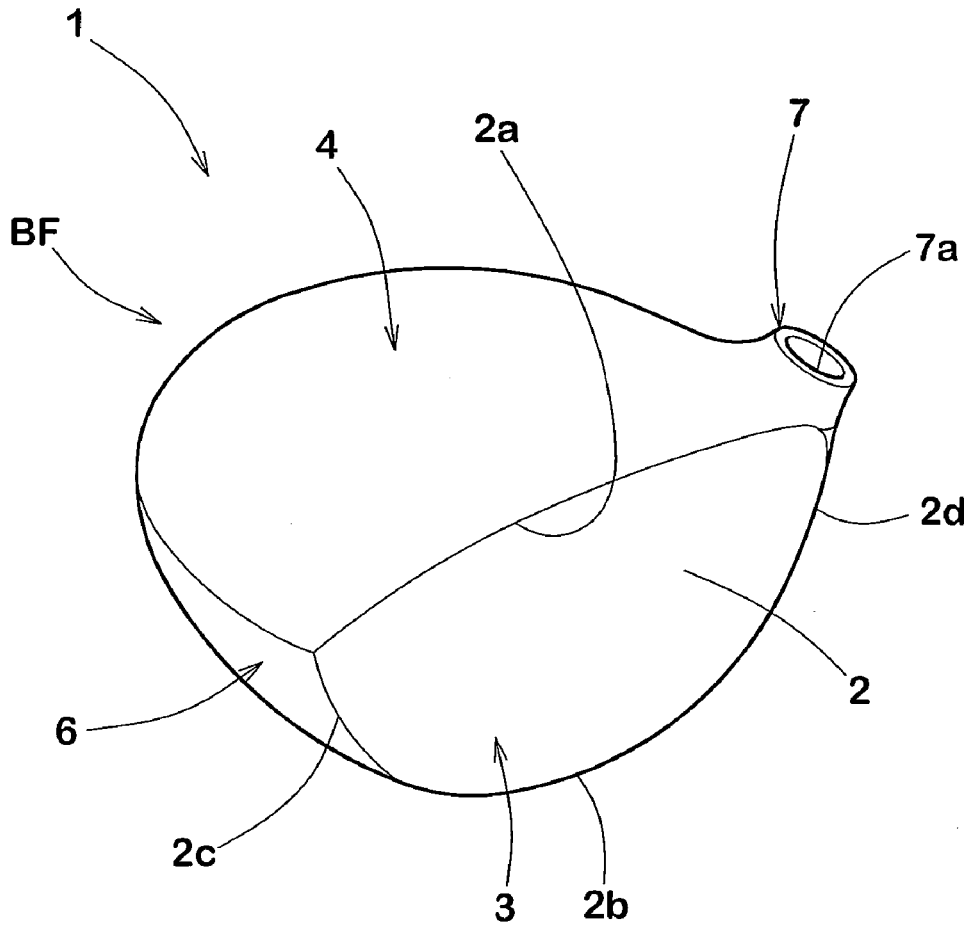
FIG. 1 is a perspective view of a golf club head according to the present invention.

Embodiments of the present invention will now be described in detail in conjunction with accompanying drawings.

In the drawings, golf club head 1 according to the present invention is a hollow head for a wood-type golf club such as driver (#1) or fairway wood, and the head 1 comprises: a face portion 3 whose front face defines a club face 2 for striking a ball; a crown portion 4 intersecting the club face 2 at the upper edge 2*a* thereof; a sole portion 5 intersecting the club face 2 at the lower edge 2*b* thereof; a side portion 6 between the crown portion 4 and sole portion 5 which extends from a toe-side edge 2*c* to a heel-side edge 2*d* of the club face 2 through the back face BF of the club head; and a hosel portion 7 at the heel side end of the crown to be attached to an end of a club shaft (not shown) inserted into the shaft inserting hole 7*a*. Thus, the club head 1 is provided with a hollow (i) and a shell structure with the thin wall.

The hollow (i) in this example is a closed void space, but it may be filled with a foamed plastic, separating from the backside of the face 3.

In order to improve the directionality of struck balls by increasing the moment of inertia of the head, it is preferable that the volume of the golf club head 1 is not less than 400 cc, more preferably not less than 420 cc, still more preferably not less than 430 cc.

However, if the volume of the club head 1 is too large, the club weight is unfavorably increased, and there is a possibility that the head can not comply with Golf rules, therefore, it is preferable that the volume of the golf club head 1 is not more than 470 cc, more preferably not more than 460 cc.

It is preferable for easy golf swing and swing balance that the mass of the golf club head 1 is not less than 180 grams, but not more than 210 grams.

Figure 3:
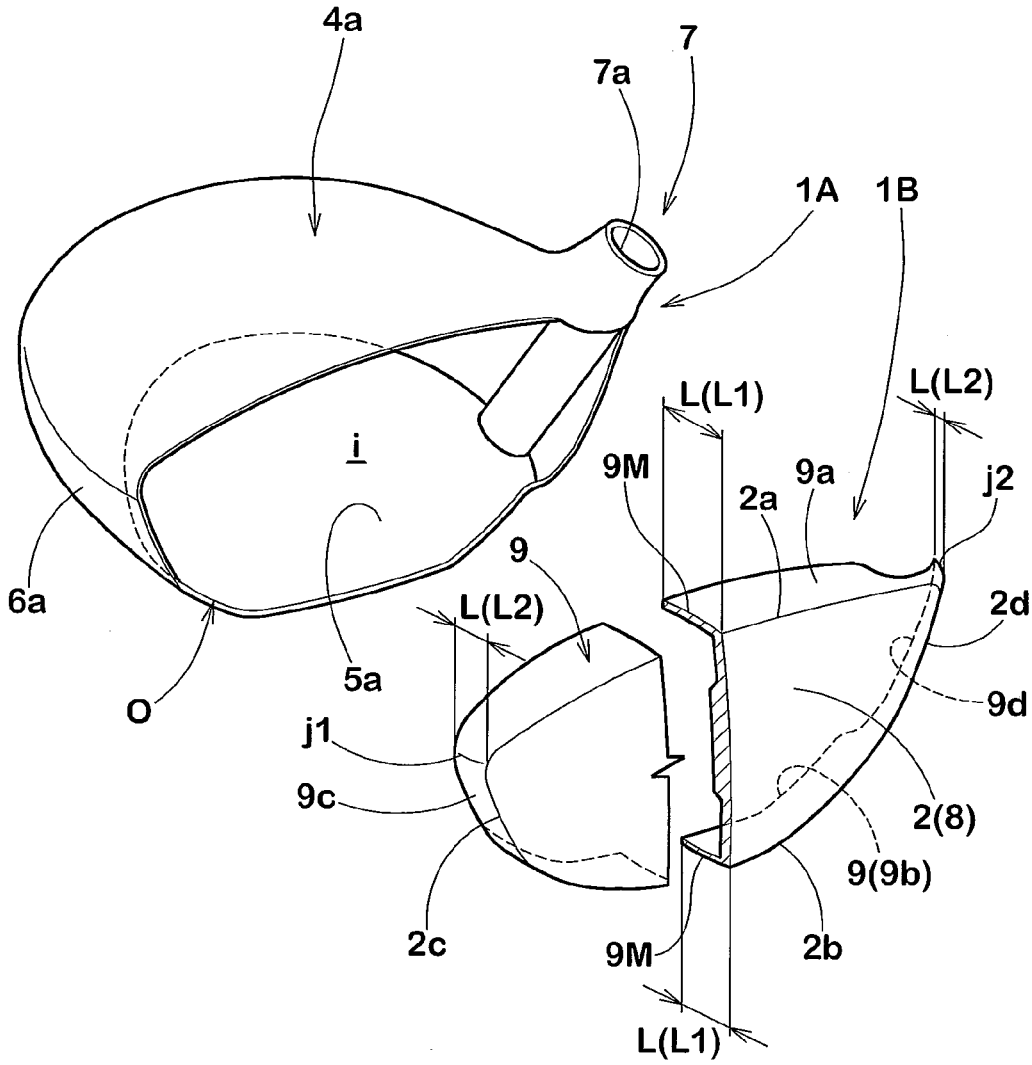
FIG. 3 is an exploded perspective view thereof.

In this embodiment, the golf club head 1 is composed of a metal head main body 1A and a metal face member 1B welded to the main body 1A as shown in FIG. 3.

The face member 1B integrally includes a main portion 8 forming at least a part of the club face 2 and a turnback 9 extending backward from at least a part of the edge (2*a*-2*d*) of the club face 2.

For the face member 1B, for example, stainless steels, maraging steels and titanium alloys can be used. Especially, titanium alloys having high specific strength, more specifically titanium alloys having alpha phase such as alpha titanium alloys and alpha-beta titanium alloys are preferably used for the face member 1B.

By using an alpha-beta alloy having high specific strength, an improvement in the durability of the face portion 3, a decrease in the thickness of the face member 1B accompanied by a weight reduction, and an increase in the flexibility of designing the center of gravity accompanying the decreased thickness may be achieved.

A typical alpha titanium alloy is Ti-5Al-2.5Sn.

Alpha-beta titanium alloys are, for example, Ti-4.5Al-3V-2Fe-2Mo, Ti-4.5Al-2Mo-1.6V-0.5Fe-0.3Si-0.03C, Ti-8Al-1Mo, Ti-1Fe-0.35O-0.01N, Ti-5.5Al-1Fe, Ti-6Al-4V, Ti-6Al-6V-2Sn, Ti-6Al-2Sn-4Zr-6Mo, Ti-6Al-2Sn-4Zr-2Mo, Ti-8Al-1Mo-1V and the like.

Because of the high specific strength and good workability, Ti-4.5Al-3V-2Fe-2Mo, Ti-4.5Al-2Mo-1.6V-0.5Fe-0.3Si-0.03C, Ti-5.5Al-1Fe and Ti-8Al-1Mo-1V are preferred.

In this embodiment, the main portion 8 corresponds to the face portion 3. In other words, the main portion 8 forms the entirety of the club face 2, and the main portion 8 forms the entire thickness of the face portion 3 from the front surface or club face 2 to the rear surface.

Figure 4A:
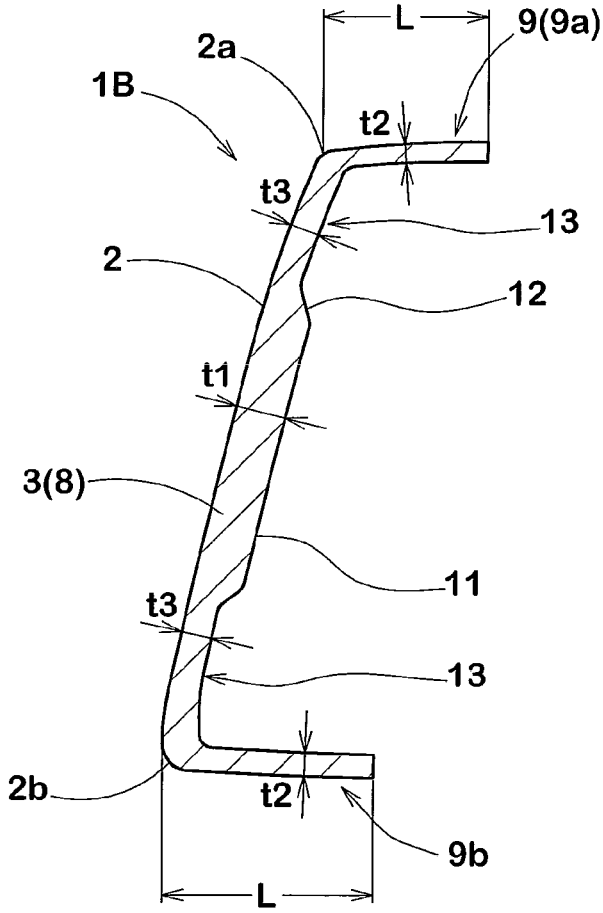
FIG. 4(*a*) is a cross sectional view of the face member taken along line A-A in FIG. 2.
Figure 4B:
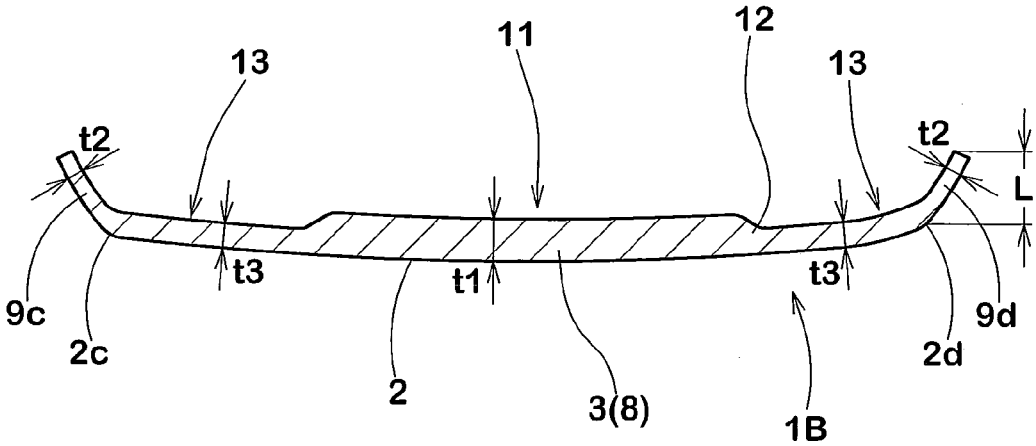

Further, the main portion 8 is provided with a thick central region 11, a thin surrounding region 13 having a thickness less than that of the thick central region 11, and an annular transitional region 12 between the regions 11 and 13 whose thickness continuously decreases towards the club face edge as shown in FIG. 4(*a*) and FIG. 4(*b*).

The thick central region 11 has a substantially constant thickness t1 which is largest in the face portion 3.

The thick central region 11 includes the sweet spot SS in its center.

The thickness t1 of the thick central region 11 is determined according to the metal material used. If the thickness t1 is too small, it becomes difficult to provide minimum durability necessary for the face portion 3. In this light, it is preferable that the thickness t1 of the thick central region 11 (namely, the maximum thickness of the face portion 3) is not less than 2.90 mm, more preferably not less than 2.97 mm, still more preferably not less than 3.00 mm, most preferably not less than 3.05 mm.

If the thickness t1 is too large, the rebound performance tends to deteriorate, causing a decrease in the flying distance of the struck ball. In this light, it is preferable that the thickness t1 of the thick central region 11 is not more than 3.90 mm, more preferably not more than 3.85 mm, still more preferably not more than 3.75 mm.

Figure 2:
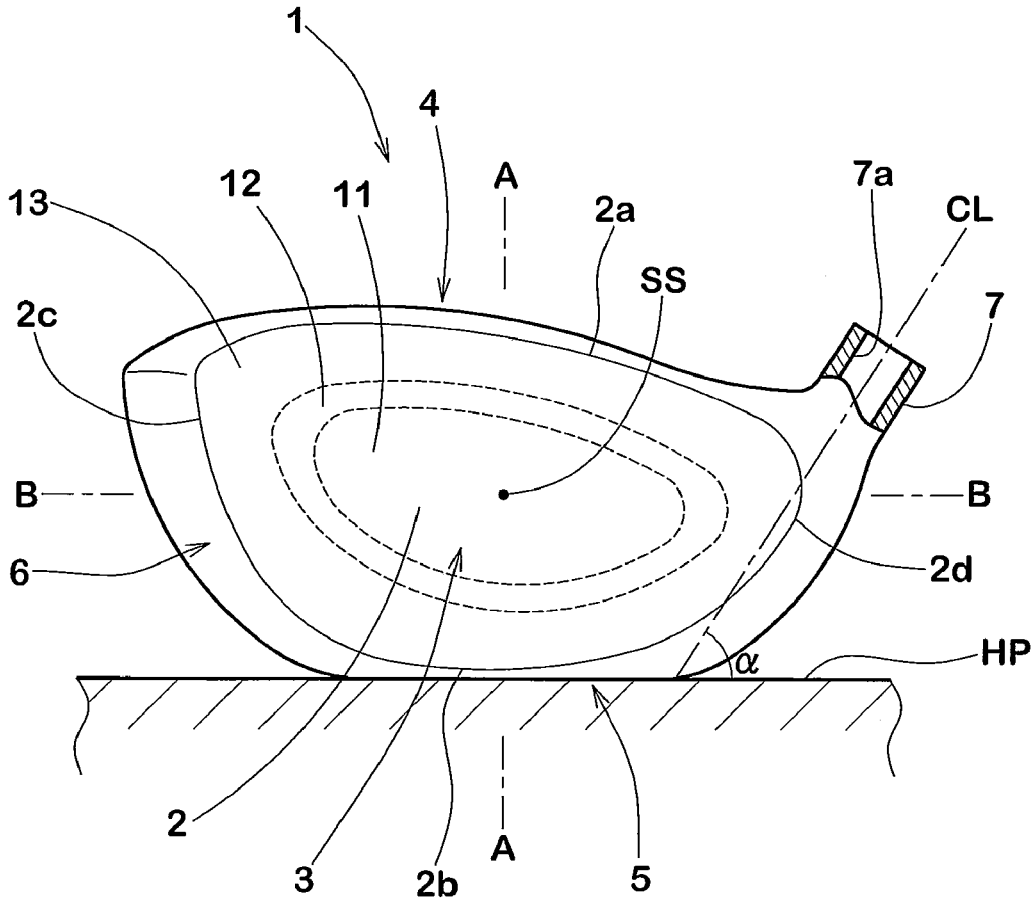
FIG. 2 is a front view thereof.

It is preferable that, as shown in FIG. 2, the thick central region 11 has a horizontally-long generally-elliptical shape similar to that of the club face 2 substantially centered on the sweet spot SS. Therefore, even in the case of average golfers whose ball hitting positions tend to vary wide towards the toe and heel, the ball hitting positions can be effectively included within the thick central region 11.

The thin surrounding region 13 has a substantially constant thickness t3 smallest in the face portion 3, which contributes a weight reduction of the face portion 3 and increases the rebound performance of the golf club head, and the carry distance may be increased.

In this embodiment, the thin surrounding region 13 is formed continuously around the thick central region 11.

The thickness t3 of the thin surrounding region may be selected depending on the material used.

However, if the thickness t3 is too small, the durability of the face portion 3 tends to become insufficient, therefore, it is desirable that the thickness t3 of the thin surrounding region 13 is not less than 1.50 mm, more preferably not less than 1.60 mm, still more preferably not less than 1.65 mm.

If the thickness t3 of the thin surrounding region 13 is too large, on the other hand, the rebound performance deteriorates and there is a possibility that the flying distance of the ball decreases. Therefore, it is preferable that the thickness t3 of the thin surrounding region 13 is not more than 2.50 mm, more preferably not more than 2.40 mm, still more preferably not more than 2.30 mm.

The transitional region 12 is formed annularly around the thick central region 11, and the thickness thereof is continuously decreased towards the thin surrounding region 13 in order to improve the durability of the face portion 3.

In this embodiment, the turnback 9 is formed along the entire circumference of the main portion 8.

As shown in FIG. 3, the turnback 9 includes: a crown-side turnback 9*a* extending backward from the upper edge 2*a* of the club face 2 to form a front end zone of the crown portion 4; a sole-side turnback 9*b* extending backward from the lower edge 2*b* of the club face 2 to form a front end zone of the sole portion 5; a toe-side turnback 9*c* extending backward from the toe-side edge 2*c* of the club face 2 to form a toe-side front end zone of the side portion 6; and a heel-side turnback 9*d* extending backward from the heel-side edge 2*d* of the club face 2 to form a heel-side front end zone of the side portion 6. By the turnback 9, the welding position between the face member 1B and head main body 1A is shifted backward away from the edge of the club face.

Since the turnback 9 forms the front end zones of the crown portion 4, sole portion 5 and side portion 6, if their maximum thickness t2 is increased, the rebound performance of the head decreases, and further, cracks and crease are liable to occur during press working. In this light, it is preferable that the maximum thickness t2 of the turnback 9 (excluding the weld bead and the like, if any) is not more than 2.50 mm, more preferably not more than 2.40 mm, still more preferably not more than 2.30 mm, especially preferably not more than 2.0 mm. If the thickness t2 of the turnback 9 is decrease, the durability of the club head is liable to decrease. In this light, it is preferable that the thickness t2 of the turnback 9 is not less than 1.70 mm, more preferably not less than 1.80 mm, still more preferably not less than 1.85 mm.

The head main body 1A in this embodiment constitutes the part of the golf club head 1 other than the face member 1B. In other words, the head main body 1A is made up of: a part 4*a* constituting a major aft part of the crown portion 4; a part 5*a* constituting a major aft part of the sole portion 5; a part 6*a* constituting a major aft part of the side portion 6; and the above-mentioned hosel portion 7, whereby an opening O which is closed by the face member 1B is formed at the front of the head main body 1A.

The head main body 1A is made of a metal material weldable with the face member 1B. For example, stainless steels, maraging steels, titanium alloys, aluminum alloys, magnesium alloys and the like can be suitably used.

As another example of the head main body 1A, for example in order to optimize the position of the center of gravity of the head, a nonmetal material having a small specific gravity such as fiber reinforced resin can be used in the crown portion, and a weight member having a large specific gravity can be used in the back of the head, in the sole portion 5 or side portion 6.

A method for manufacturing the above-mentioned golf club head as an embodiment of the present invention is described in detail below.

Firstly, the head main body 1A and the face member 1B are manufactured.

In the case of the head main body 1A in this embodiment which is made of a single metal material, it is desirable that the head main body 1A is formed as a single casting through a lost-wax precision casting method.

In the case of the face member 1B, it is formed through at least the following processes (a) to (d).

Process (a):

In the process (a), the rolled metal plate M of a constant thickness is prepared.

Figure 5:
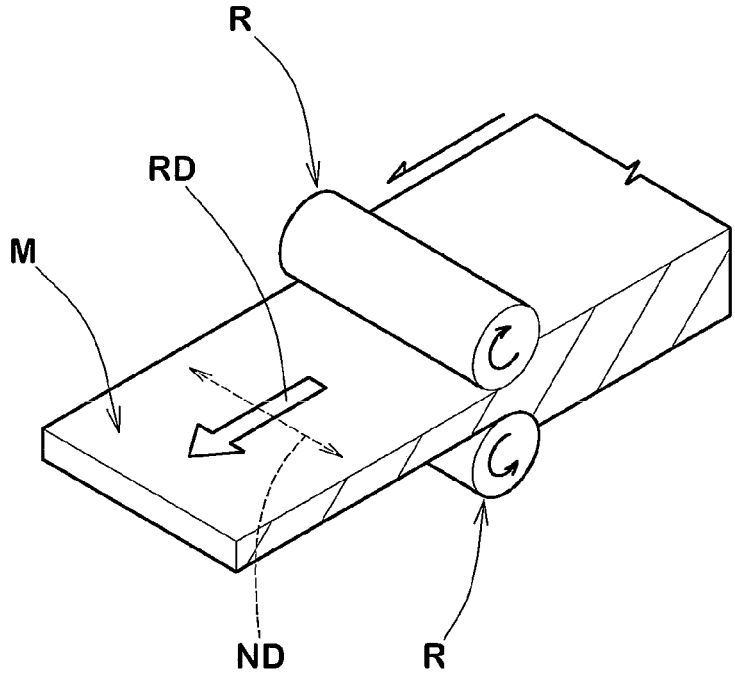
FIG. 5 is a perspective view for explaining the rolled metal plate.

The rolled metal plate M is a metal plate which is, as shown in FIG. 5, manufactured through a rolling operation, in which the material metal is dragged between oppositely rotating rolls by utilizing the friction therebetween and the thickness and sectional area are reduced.

Figure 6A:
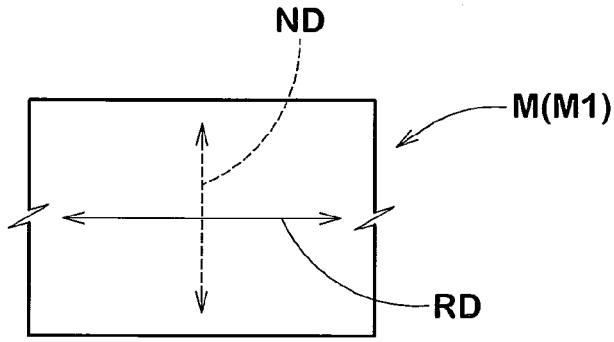
FIG. 6(*a*) is a plan view for explaining a unidirectional rolling.
Figure 6B:
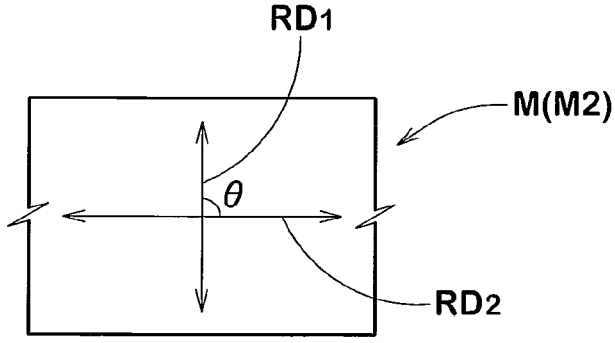

The rolled metal plate M means either a unidirectional rolled metal plate M1 which is prepared by rolling repeatedly in one rolling direction RD as shown in FIG. 6(*a*), or a multidirectional rolled metal plate M2 which is prepared by rolling repeatedly in at least two different rolling directions including two orthogonal directions RD1 and RD2 as shown in FIG. 6(*b*).

In this embodiment, either a unidirectional rolled metal plate M1 or a multidirectional rolled metal plate M2 can be used for the face member 1B.

Figure 7:
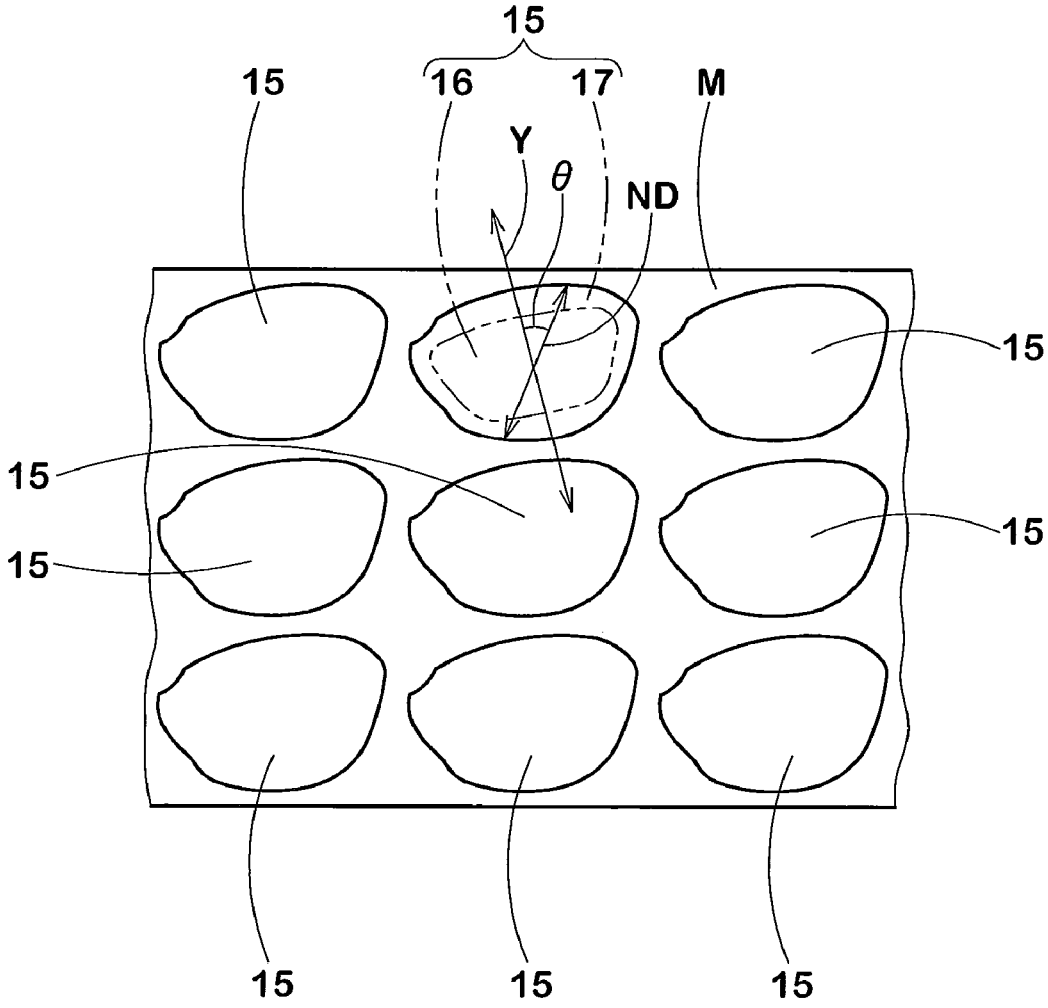
FIG. 7 is a plan view of the rolled metal plate for explaining the cutting-out operation in the process (b).

Process (b):

In the process (b), an in-process face material 15 for the face member is prepared. More specifically, after the process (a), an in-process face material 15 is cut out from the rolled metal plate M as shown in FIG. 7.

The contour shape of the in-process face material 15 is such that a corresponding-to-main region 16 for forming the main portion 8 and a corresponding-to-turnback region 17 for forming the turnback 9 are at least included. In other words, the contour shape of the in-process face material 15 may be such that it further includes a cutting stock and the like in its peripheral edge portion.

For example, using a cutting die, a laser cutting machine or the like, a large number of the in-process face materials 15 can be cut out in multiple rows and multiple columns from the same rolled metal plate M.

Process (c):

In the process (c), the face member 1B is made.

More specifically, after the process (b), the turnback 9 is formed on the in-process face material 15 by press working (drawing). Thus, the face member 1B is formed.

Figure 8A:
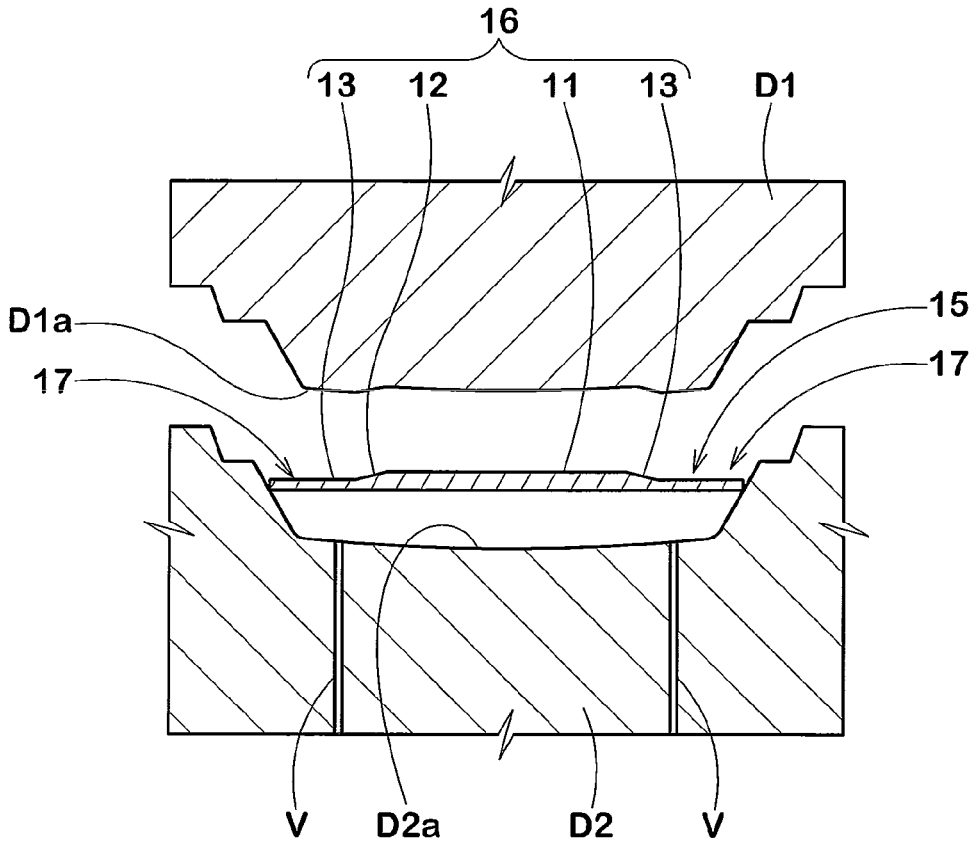
FIGS. 8(*a*) and 8(*b*) are cross sectional views for explaining the press working in the process (c).
Figure 8B:
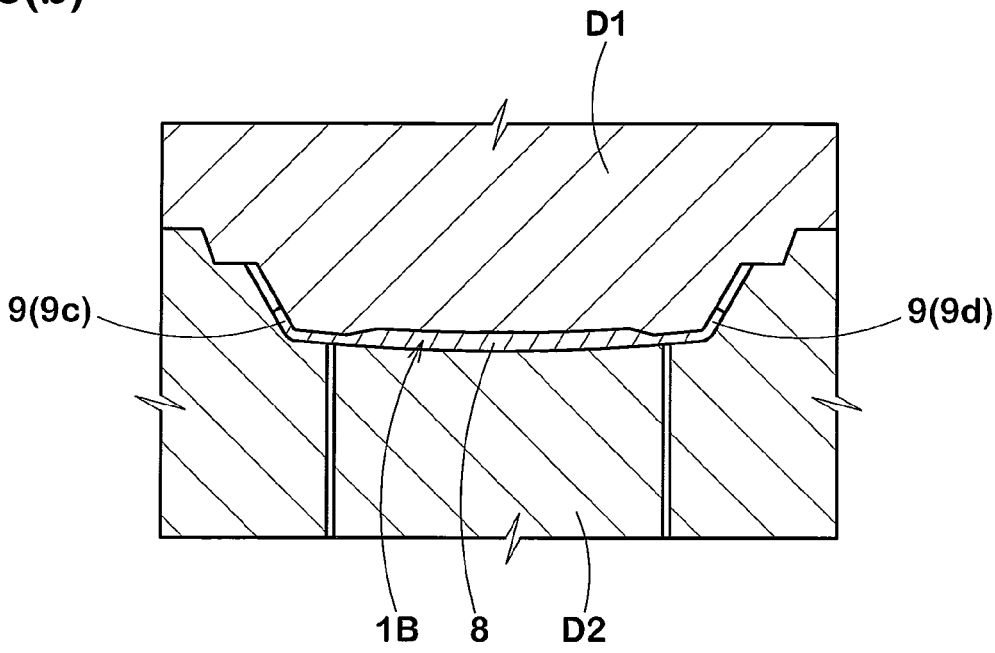

As shown in FIGS. 8(*a*) and 8(*b*), a press working (drawing) operation is carried out by the use of paired drawing dies D1 and D2.

One drawing die D2 is provided with a hollow D2*a* defining a molding surface for molding the club face 2 (namely, front surface) of the face member 1B. The molding surface is provided with vent holes (V).

The other drawing die D1 is provided with a swell D1*a* defining a molding surface for molding the back surface of the club face 2. In the press working operation, the in-process face material 15 cut out from the rolled metal plate M is placed in the hollow D2*a* of the female drawing die D2 as shown in FIG. 8(*a*).

Then, as shown in FIG. 8(*b*), the positive drawing die D1 is rammed down towards the in-process face material 15 in the female drawing die D2, therefore, the corresponding-to-turnback region 17 is bent backward of the head, causing a plastic deformation. Thereby, the face member 1B with the turnback is manufactured.

The press working can be made only one time or plural times on each face material 15 as needed.

Figure 9A:
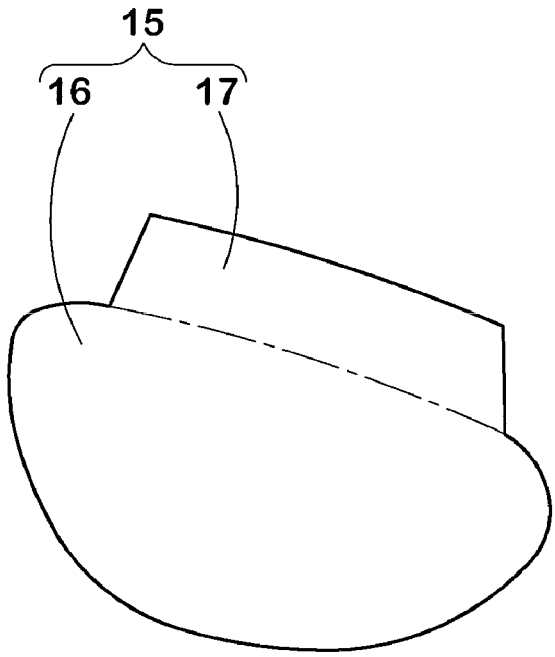
FIG. 9(*a*) and FIG. 9(*b*) are a developed view and a perspective view of another example of the face member.
Figure 9B:
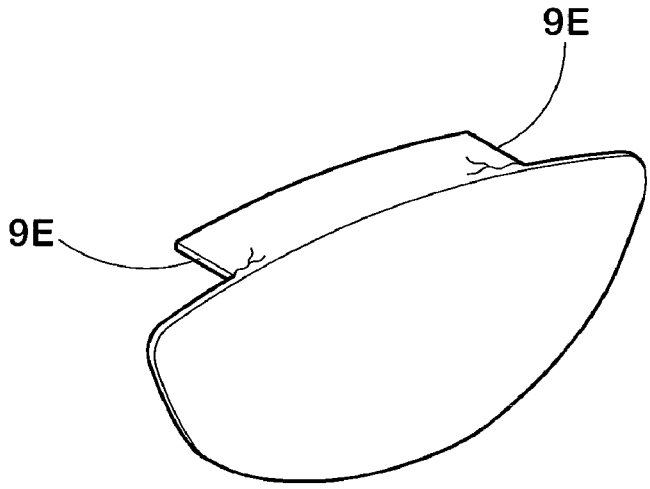
Figure 10A:
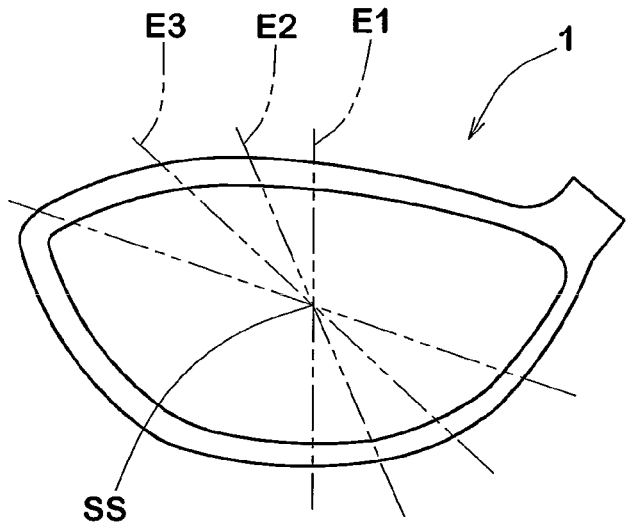
FIG. 10(*a*) and FIG. 10(*b*) are a front view and a cross sectional view of the face portion of a head for explaining the definition of the peripheral edge of the club face, FIG. 11(*a*) and FIG. 11(*b*) are perspective views for explaining the process (d).
Figure 10B:
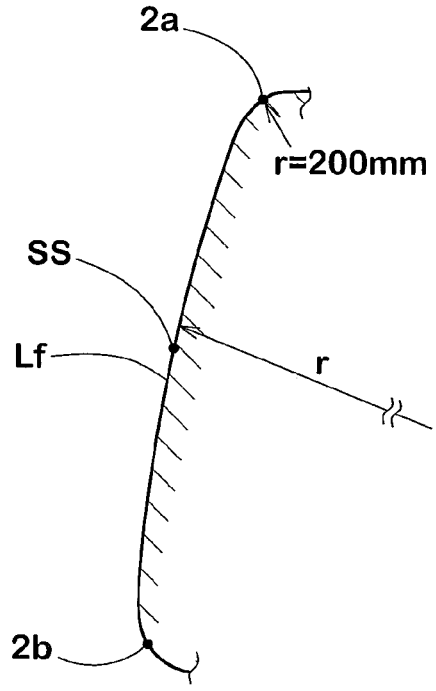

Since the corresponding-to-turnback region 17 is bent largely during press working, as shown in FIG. 9(*a*) for example, if the corresponding-to-turnback region 17 is not formed continuously around the corresponding-to-main region 16, namely, if the corresponding-to-turnback region 17 is formed partially, then, as shown in FIG. 9(*b*), there is a possibility that, due to the large stress concentration, the base of the side edges 9E of the turnback 9 causes cracks after the press working.

In this embodiment, however, since the corresponding-to-turnback region 17 is formed continuously around the main portion 8, such damage can be effectively prevented.

In the case of a turnback having a large size (L) in the front-back direction of the head, in order to form such turnback by press working, a large pressure is required, therefore, there is a possibility that the equipment cost and production cost increase. Further, as shown in FIG. 3, in the intersecting part j1 between the crown-side turnback 9*a* and toe-side turnback 9*c* and also in the intersecting part j2 between the crown-side turnback 9*a* and heel-side turnback 9*d*, the amount of plastic deformation of these parts j1 and j2 during press working becomes relatively large and further the deformation is not simple, therefore, damage is especially liable to occur.

Therefore, in the turnback 9 in this embodiment, a large-size part 9M whose size (L) in the front-back direction reaches to a maximum value L1 is formed in the crown-side turnback 9*a* and/or sole-side turnback 9*b* which are subjected to relatively simple deformation (bending deformation) during press working. And the toe-side turnback 9*c* and heel-side turnback 9*d* include a part whose size L2 in the front-back direction is not more than 50% of the above-mentioned value L1 of the large-size part 9M.

It is especially preferable that the intersecting parts j1 and j2 and the vicinity thereof have the above-mentioned size L2 of not more than 50% of the value L1 of the large-size part. Thereby, it is possible to preserve an appropriate size of the turnback 9 which can prevent deterioration of the rebound performance of the club head 1 and occurrence of the damage of the turnback 9 during press working.

In the turnback 9 in this embodiment, as shown in FIG. 3, each of the toe-side turnback 9*a* and heel-side turnback 9*b* is provided in its middle part in the toe-heel direction with the above-mentioned large-size part 9M. And the size L of the turnback is continuously decreased towards the toe and heel from the middle part in order to prevent stress concentration during press working and improve the formability.

In this embodiment, the toe-side turnback 9*c* and heel-side turnback 9*d* are formed continuously so that almost entirety thereof has size of not more than 50% of the maximum size L1 although it is not always necessary to have such structure.

In the golf club head 1, if the size L of the turnback 9 is too small, then the weld junction between the face member 1B and head main body 1A approaches the edge of the club face, and the rebound performance of the club head is greatly decreased. In this light, it is preferable that the size L of the turnback 9 in the front-back direction is not less than 3.0 mm, more preferably not less than 5.0 mm, still more preferably not less than 6.0 mm.

If the size L is too large, on the other hand, then the amount of tensile deformation occurring on the outer surface side during press working is increased, and cracks and/or crease become liable to occur on the outer surface. Further, there is a possibility that the shape of the turnback 9 varies due to the difference in the residual stress between the inner surface and outer surface of the turnback 9. Therefore, it is preferable that the size L of the turnback 9 is preferably not more than 13.0 mm, more preferably not more than 11.0 mm, still more preferably not more than 10.0 mm.

Process (d):

The process (d) is carried out after the process (a) but before the process (c). More specifically, in the state of the in-process face material 15 cut out from the rolled metal plate M, OR in the state of the rolled metal plate M as shown in FIG. 11, the corresponding-to-turnback region 17 is cut into a specific shape.

In this embodiment, in view of the production efficiency, the process (d) is carried out between process (a) and process (b) in the state of the rolled metal plate M.

Figure 11A:
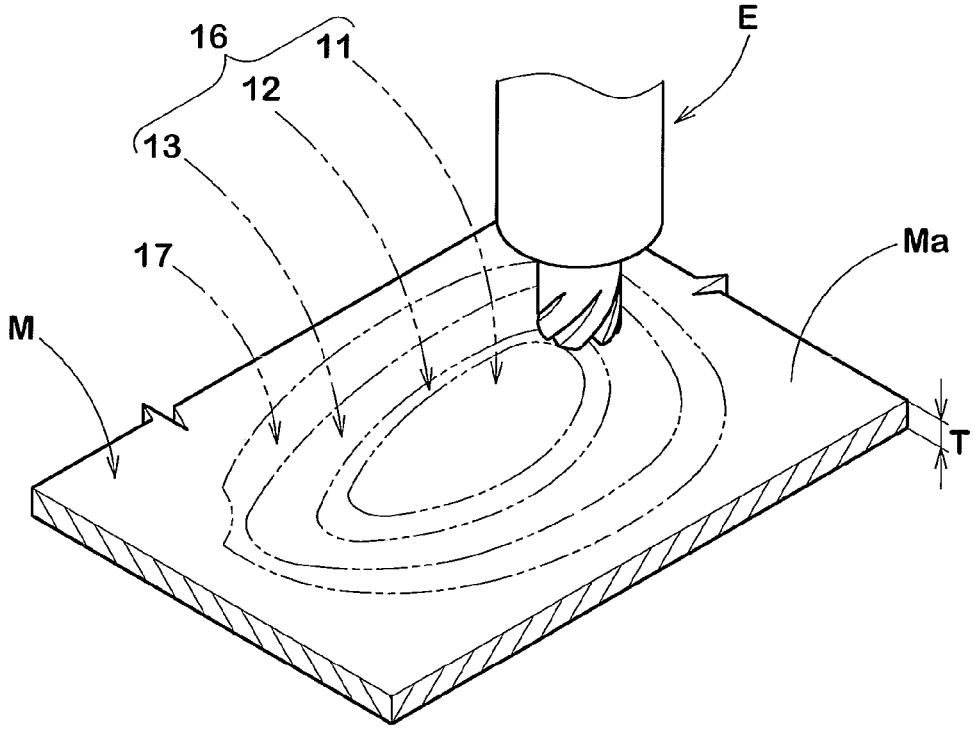
Figure 11B:
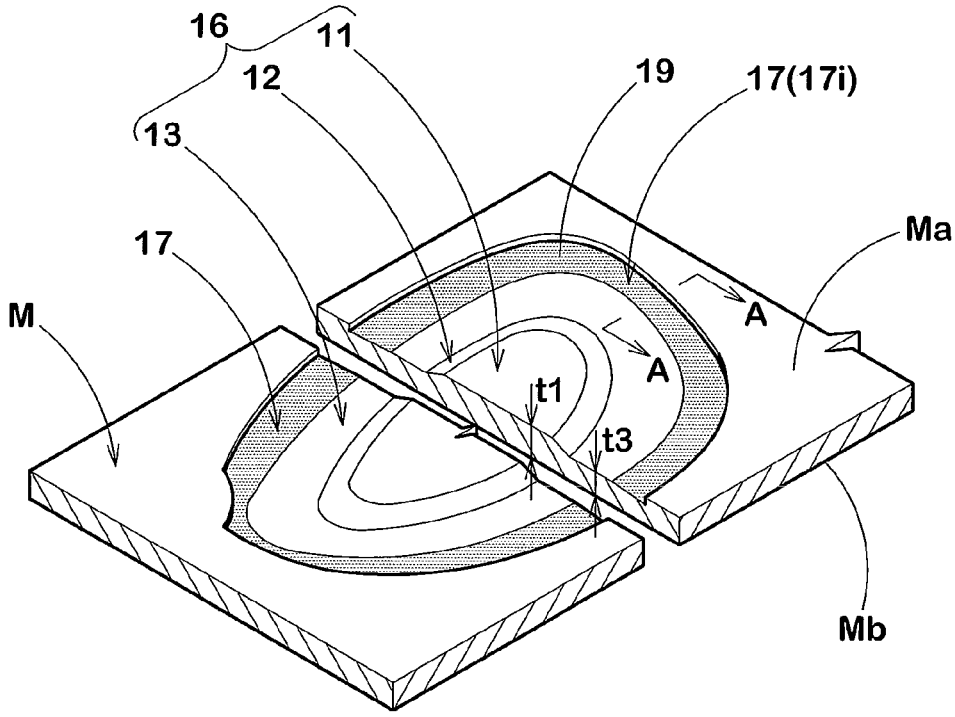

In the cutting of the corresponding-to-turnback region 17, for example as shown in FIGS. 11(*a*) and 11(*b*), the rolled metal plate M is fixed onto a bench of a cutting machine (not shown), exposing the inner surface Ma of the rolled metal plate M or the surfaces of the corresponding-to-turnback region 17 and corresponding-to-main region 16 which face the hollow (i) in the finished golf club head, and the thickness of the corresponding-to-turnback region 17 is reduced by the use of a cutting blade E such as end mill (or face mill).

The cutting work can be carried out with for example a computer numerical controlled three- to five-axis machine having a plurality of cutting blades. The data used in the cutting work, e.g. cutting position, width, depth and the like are programmed beforehand and stored in the computer of the machine At any rate, the thick central region 11, thin surrounding region 13 and transitional region 12 are formed in the corresponding-to-main region 16.

When the original thickness T of the rolled metal plate M is the same as the thickness t1 of the thick central region 11, the thick central region 11 can be formed without cutting.

By the cutting, the transitional region 12 and thin surrounding region 13 are formed around the thick central region 11.

Figure 12A:
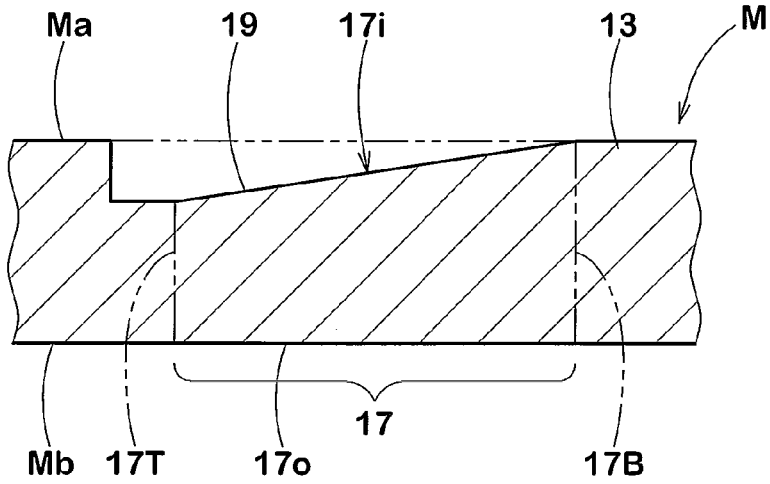
FIG. 12(*a*) is a cross sectional view taken along line A-A in FIG. 11(*b*).
Figure 12B:
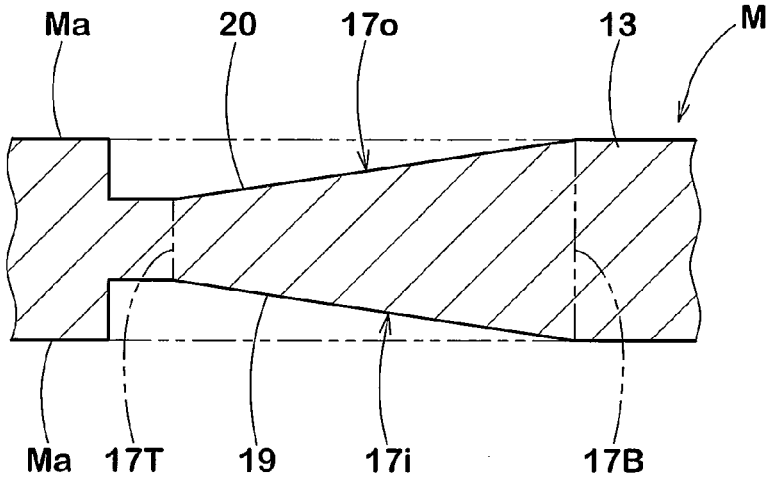
Figure 12C:
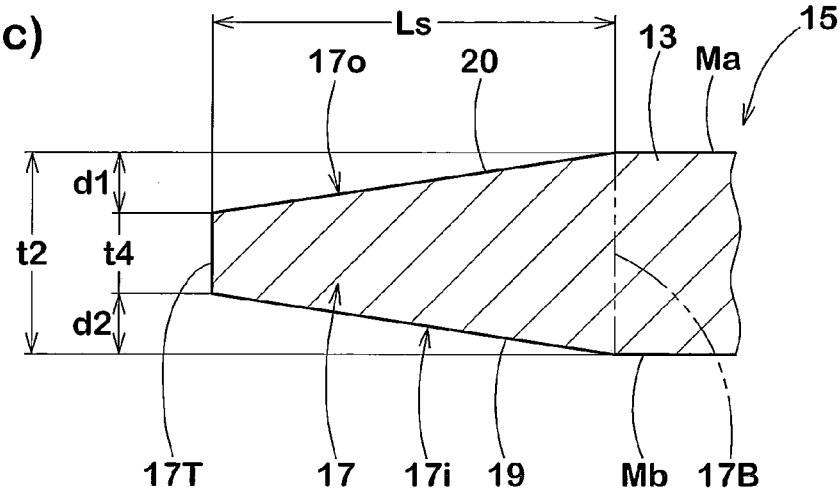

FIG. 12(*a*) is a cross sectional view taken along line A-A in FIG. 11(*b*).

By the cutting, the inner surface 17*i* of the corresponding-to-turnback region 17 is provided with an inclined surface 19. The inclined surface 19 in this embodiment is constantly inclined to the outer surface 17*o* of the corresponding-to-turnback region 17 toward the peripheral edge 17T of the corresponding-to-turnback region 17.

Figure 13:
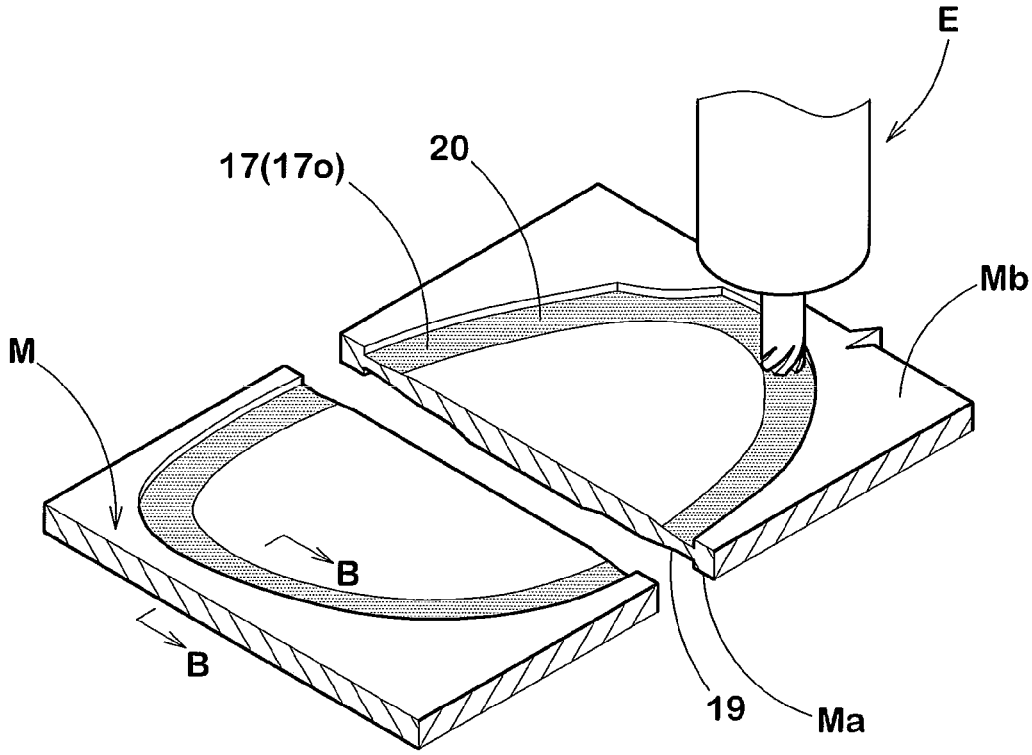
FIG. 13 is a perspective view of the rolled metal plate for explaining the process (d).

After the above-mentioned cutting operation on the inner surfaces of the corresponding-to-turnback region 17 and corresponding-to-main region 16 is done as shown in FIG. 11(*b*), the rolled metal plate M is turned inside out to expose its outer surface Mb which becomes the outer surface of the finished golf club head and a cutting operation is made for the corresponding-to-turnback region 17 as shown in FIG. 13.

FIG. 12(*b*) is a cross sectional view taken along line B-B in FIG. 13.

In the outer surface 17*o* of the corresponding-to-turnback region 17, there is formed an inclined surface 20. The inclined surface 20 is constantly inclined to the inner surface 17*i* of the corresponding-to-turnback region 17 towards the peripheral edge 17T of the corresponding-to-turnback region 17. Therefore, the corresponding-to-turnback region 17 is tapered, gradually decreasing its thickness towards the peripheral edge 17T.

Then, the in-process face material 15 is cut out from the rolled metal plate M along the outline of the peripheral edge 17T of the corresponding-to-turnback region 17, whereby, as shown in FIG. 12(*c*), the cut-out in-process face material 15 has the corresponding-to-turnback region 17 whose inner surface 17*i* and outer surface 17*o* are both machined.

At the time of cut-out, the width Ls of the corresponding-to-turnback region 17 is set in a range of about 80 to 100% of the size L of the corresponding-to-turnback region 17 after subjected to the press working.

Here, the expression "continuously decrease" is meant for both of a decrease at a constant rate and a decrease at a variable rate.

Figure 14:
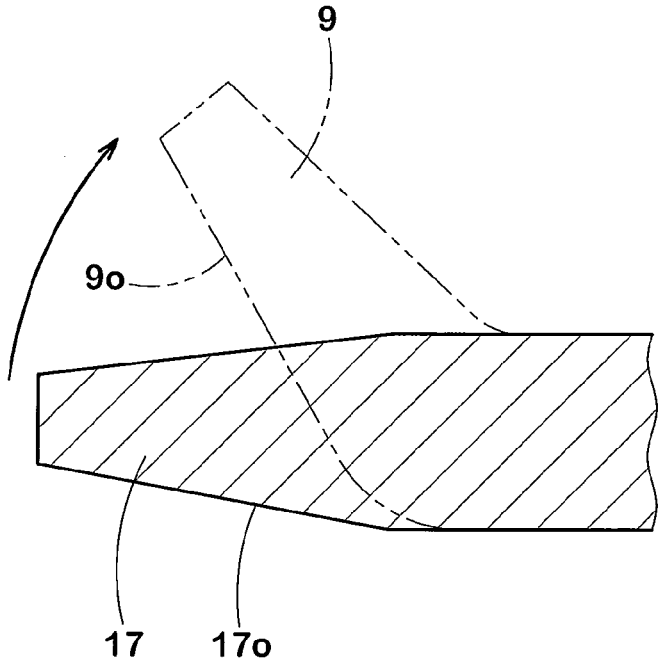
FIG. 14 is a cross sectional view of the corresponding-to-turnback region.

As explained, by the cutting work prior to the press working of the process (c), the thickness of the corresponding-to-turnback region 17 is continuously decreased towards the peripheral edge 17T and the inclined surface 20 having a specific shape is formed in the outer surface 17*o*, therefore, as shown in FIG. 14, at the time of the press working, the amount of bending of the corresponding-to-turnback region 17 is decreased, and a tensile stress occurring in the outer surface 17*o* can be mitigated, cracks of the outer surface 90 of the bent turnback 9 can be effectively prevented, and the forming accuracy of the turnback 9 is increased to improve the yield rate.

The main portion 8 for hitting a ball has a thickness more than that of the corresponding-to-turnback region 17, therefore, a sufficient durability can be provided.

According to the present invention, the non-flat face member can be manufactured from the rolled metal plate at a high yield rate, therefore the golf club head can be manufactured at a low manufacturing cost.

In the above-mentioned embodiment, by the cutting works, the inner surface 17*i* and outer surface 17*o* of the corresponding-to-turnback region 17 are both provided with the inclined surfaces 19 and 20.

The outer surface 17*o* should be provided with the inclined surface 20, but it is not always necessary for the inner surface 17*i* to form the inclined surface 19 by the cutting work. In this regard, however, in order to press finish the non-flat face member 1B with high dimensional accuracy, it is preferable that the inclined surfaces 19 and 20 are formed in the inner surface 17*i* and outer surface 17*o* of the corresponding-to-turnback region 17 as in the above-mentioned embodiment.

As to the configurations of the inclined surfaces 19 and 20, smooth curve lines can be employed aside from the straight configuration as shown in FIG. 12.

If the thickness t4 of the peripheral edge 17T of the corresponding-to-turnback region 17 is too small, then due to the repetition of the stress at impact, there is a possibility that cracks occur at an early stage. If too large on the other hand, there is a possibility that the rebound performance deteriorates and the mass of the face member 1B is undesirably increased. In this light, it is preferable that the thickness t4 is not less than 0.80 mm, more preferably not less than 0.90 mm, still more preferably not less than 0.95 mm, but not more than 1.60 mm, more preferably not more than 1.55 mm, still more preferably not more than 1.50 mm.

The thickness of the base 17B of the corresponding-to-turnback region 17 is set to be substantially same as the maximum thickness t2 of the turnback 9.

It is preferable that the quotient (t2−t4)/Ls of the difference (t2−t4) between the thickness t2 of the base 17B of the corresponding-to-turnback region 17 and the thickness t4 of the peripheral edge 17T, divided by the width Ls of the corresponding-to-turnback region is not less than 0.03, more preferably not less than 0.05, still more preferably not less than 0.07, but not more than 0.35, more preferably not more than 0.33, still more preferably not more than 0.30.

If the quotient (t2−t4)/Ls is less than 0.03, the denominator Ls tends to become large for the numerator (t2−t4). In this case, it becomes difficult to bend the corresponding-to-turnback region 17 by press working, and the product failure and production costs tend to increase. If the quotient (t2−t4)/Ls is more than 0.35, on the other hand, the denominator Ls tends to become small for the numerator (t2−t4), therefore, the upper limit is preferably 0.35.

For the in-process face material 15 prior to the press working, it is preferable that the cutting depth d1 of the inclined surface 20 formed on the outer surface 17*o* of the corresponding-to-turnback region 17 (namely, the maximum depth to the inclined surface as show in FIG. 12(*c*)) is not less than 0.15 mm, more preferably not less than 0.18 mm, still more preferably not less than 0.20 mm. If the cutting depth d1 is less than 0.15 mm, there is a possibility that the tensile stress of the outer surface of the corresponding-to-turnback region 17 during press working can not be well decreased. If the cutting depth d1 is too large, there is a possibility that the strength of the corresponding-to-turnback region 17 is remarkably decreased. Therefore, it is preferable that the cutting depth d1 is not more than 0.50 mm, more preferably not more than 0.48 mm, still more preferably not more than 0.45 mm, It is preferable that the ratio (d1/Ls) of the cutting depth d1 and the width Ls of the corresponding-to-turnback region is not less than 0.015, more preferably not less than 0.020, still more preferably not less than 0.025.

If the ratio (d1/Ls) is less than 0.015, there is a tendency that the width Ls becomes large for the cutting depth d1, and the surface is damaged during press working. If the ratio (d1/Ls) becomes too large, there is a tendency that the width Ls becomes small for the cutting depth d1, therefore, the ratio (d1/Ls) is preferably less than 0.090, more preferably less than 0.085.

In the case that the inclined surface 19 is formed in the inner surface 17*i* of the corresponding-to-turnback region 17, it is preferable that the cutting depth d2 of the inclined surface 19 (namely, the maximum depth to the inner surface 17*i* as shown in FIG. 12(*c*)) is not less than 0.10 mm, more preferably not less than 0.13 mm, still more preferably not less than 0.15 mm, but not more than 0.30 mm, more preferably not more than 0.28 mm, still more preferably not more than 0.25 mm.

It is preferable that the cutting depth d2 of the inner surface 17*i* is less than the cutting depth d1 of the outer surface 17*o*.

The ratio (d1/d2) is preferably not less than 2.0, more preferably not less than 2.2, still more preferably not less than 2.5. Thereby, it becomes possible to bend the corresponding-to-turnback region 17 with high dimensional accuracy without causing cracks and crease.

It is preferable that the ratio (d1/d2) is not more than 5.0, more preferably less than 4.8, still more preferably less than 4.5.

Heretofore, a unidirectional rolled metal plate M1 made of a titanium alloy having alpha phase has a strength anisotropy such that the tensile strength Ts1 in the rolling direction RD is smaller than the tensile strength Ts2 in the direction ND normal to the rolling direction RD.

If the in-process face material has such strength anisotropy and, during press working of process (c), it is bent along the rolling direction RD in which direction the tensile strength is lower, damage such as cracks are liable to occur.

Therefore, in the case that a unidirectional rolled metal plate having such a strength anisotropy has to be used, it is necessary to reduce the strength anisotropy in advance by making a thermal treatment and/or additional multidirectional rolling which increase the production costs.

In contrast, in the case of the corresponding-to-turnback region 17, the tensile stress occurring in the outer surface 17*o* during press working can be reduced, therefore, even if the unidirectional rolled metal plate having the strength anisotropy is used, the above-mentioned damages can be prevented, and the production costs can be reduced.

As a result, the range of choice for the metal material is widened, and the production costs can be reduced.

Further, in this embodiment, it becomes possible to provide advantage of the durability to the face member 1B by making use of the strength anisotropy. Specifically, the angle theta between the above-mentioned normal direction ND of the rolled metal plate M and the up-and-down direction Y of the club face is set to be not more than 45 degrees more preferably not more than 30 degrees. More specifically, in the process (b), as shown in FIG. 7, in order to meet above-mentioned limitation for the angle theta, the in-process face material 15 is cut out from the rolled metal plate M. As a result, the face portion can be improved in the durability without increasing the thickness.

In order to derive the above-mentioned advantageous effects, it is preferable that the rolled metal plate M has such strength anisotropy that the ratio (Ts2/Ts1) of the tensile strength Ts2 in the normal direction ND to the tensile strength Ts1 in the rolling direction RD is not less than 1.06, more preferably not less than 1.10, still more preferably not less than 1.15. But, in order to avoid an excessive decrease in the tensile strength Ts1 in the rolling direction RD, the ratio (Ts2/Ts1) is preferably not more than 1.60, more preferably not more than 1.50, still more preferably not more than 1.35.

As shown in FIG. 8, the positive drawing die D1 used in the press working is provided with a non-flat molding surface corresponding to the thick central region 11, thin surrounding region 13 and transitional region 12 of the in-process face material 15. The non-flat molding surface can help to accurately position the in-process face material 15 relatively to the positive drawing die D1 during press working, and can prevent a possible displacement of the in-process face material 15 caused by the pushing-in of the positive drawing die D1. Accordingly, the press working in this embodiment can shape the corresponding-to-turnback region 17 into the turnback 9 with high dimensional accuracy.

The manufacturing method in this embodiment further includes a process for giving a bulge and/or roll to the main portion 8 of the face member 1B. This process can be incorporated in the press working of the process (c). In this case, the production efficiency can be further improved. Further, this process can be incorporated in the process (b) such that the in-process face material 15 is cut out from the rolled metal plate M by the use of cutting dies provided with a curved surface corresponding to the bulge and/or roll. In this case too, the production efficiency can be improved. However, it is also possible to carry out the process for giving a bulge and/or roll as an independent process.

Finally, the face member 1B is welded to the head main body 1A, thus, the golf club head 1 is manufactured.

As to the welding method, Tig welding, plasma welding, laser welding and the like can be employed. But, soldering may be employed as a kind of welding. Especially, the use of laser welding and/or plasma welding is preferred because the heat-affected zone can be minimized and the joint strength can be maximized.

Comparison Tests

Wood-type golf club heads having substantially same external forms were manufactured, using face members having specifications shown in Table 1, and the process yield of each face member was obtained.

The process yield was determined from the results of fifty samples of each face member. The larger value is better. When the sample fallen under the following situations, such sample was rejected: the turnback was cracked; the turnback could not be formed; the size of the turnback differed from the design value by 1 mm or more; and the turnback could not fit to the front opening of the head main body.

The results are shown in Table 1.

Common specifications are follows:

head volume: 460 cc
loft angle: 11.5 degrees
lie angle: 57.5 degrees
head main body: lost-wax precision casting of Ti-6Al-4V
welding method: plasma welding
bulge/roll process: incorporated in the press working in process (c)
normal direction to the rolling direction: at 30 degrees with respect to the up-and-down direction of the head

TABLE 1

| Head | Ex. 1 | Ex. 2 | Ex. 3 | Ex. 4 | Ex. 5 | Ex. 7 | Ref. 1 | Ex. 8 | Ref. 2 | Ref. 3 |
|---|---|---|---|---|---|---|---|---|---|---|
| Face member | | | | | | | | | | |
| Rolled metal plate *1 | M1 | M1 | M1 | M2 | M2 | M2 | M1 | M1 | M2 | M2 |
| Ts2/Ts1 | 1.15 | 1.15 | 1.15 | 1.21 | 1.21 | 1.32 | 1.15 | 1.15 | 1.21 | 1.32 |
| Order of processes *2 | | | | | | | | | | |
| 1st | cut | cut | cut | cut | cut | cut | cut | cut | cut | cut |
| 2nd | CNC | CNC | CNC | CNC | CNC | CNC | CNC | CNC | CNC | CNC |
| inclined surface | I&O | I&O | I&O | I&O | I&O | I&O | I | O | I | I |
| 3rd | press | press | press | press | press | press | press | press | press | press |
| Width of Corresponding-to-turnback region | | | | | | | | | | |
| crown-side Ls1 (mm) | 10 | 8 | 10 | 10 | 5 | 10 | 10 | 10 | 10 | 10 |

TABLE 1-continued

| Head | Ex. 1 | Ex. 2 | Ex. 3 | Ex. 4 | Ex. 5 | Ex. 7 | Ref. 1 | Ex. 8 | Ref. 2 | Ref. 3 |
|---|---|---|---|---|---|---|---|---|---|---|
| sole-side Ls2 (mm) | 10 | 8 | 10 | 10 | 5 | 10 | 10 | 10 | 10 | 10 |
| toe-side Ls3 (mm) | 5 | 3 | 7 | 5 | 3 | 5 | 5 | 5 | 5 | 5 |
| heel-side Ls4 (mm) | 5 | 5 | 3 | 5 | 3 | 5 | 5 | 5 | 5 | 5 |
| Thickness | | | | | | | | | | |
| t1 (mm) | 3.28 | 3.37 | 3.32 | 3.45 | 3.53 | 3.48 | 3.33 | 3.36 | 3.43 | 3.50 |
| t3 (mm) | 1.95 | 2.05 | 2.07 | 2.20 | 2.27 | 2.35 | 2.08 | 2.11 | 2.28 | 2.30 |
| t2(mm) | 1.45 | 1.40 | 1.35 | 1.43 | 1.38 | 1.44 | 1.46 | 1.49 | 1.40 | 1.45 |
| t4(mm) | 0.95 | 1.05 | 1.02 | 0.98 | 1.05 | 1.08 | 1.05 | 1.02 | 0.99 | 1.03 |
| t2 − t4 (mm) | 0.50 | 0.35 | 0.33 | 0.45 | 0.33 | 0.36 | 0.41 | 0.47 | 0.41 | 0.42 |
| Cutting depth | | | | | | | | | | |
| d1(mm) | 0.35 | 0.25 | 0.23 | 0.36 | 0.25 | 0.24 | 0.00 | 0.47 | 0.00 | 0.00 |
| d2(mm) | 0.15 | 0.10 | 0.10 | 0.09 | 0.08 | 0.12 | 0.41 | 0.00 | 0.41 | 0.42 |
| (t2 − t4)/Ls1 | 0.05 | 0.04 | 0.03 | 0.05 | 0.07 | 0.04 | 0.04 | 0.05 | 0.04 | 0.04 |
| (t2 − t4)/Ls2 | 0.05 | 0.04 | 0.03 | 0.05 | 0.07 | 0.04 | 0.04 | 0.05 | 0.04 | 0.04 |
| (t2 − t4)/Ls3 | 0.10 | 0.12 | 0.05 | 0.09 | 0.11 | 0.07 | 0.08 | 0.09 | 0.08 | 0.08 |
| (t2 − t4)/Ls4 | 0.10 | 0.07 | 0.11 | 0.09 | 0.11 | 0.07 | 0.08 | 0.09 | 0.08 | 0.08 |
| d1/Ls1 | 0.04 | 0.03 | 0.02 | 0.04 | 0.05 | 0.02 | 0.00 | 0.05 | 0.00 | 0.00 |
| d1/Ls2 | 0.04 | 0.03 | 0.02 | 0.04 | 0.05 | 0.02 | 0.00 | 0.05 | 0.00 | 0.00 |
| d1/Ls3 | 0.07 | 0.08 | 0.03 | 0.07 | 0.08 | 0.05 | 0.00 | 0.09 | 0.00 | 0.00 |
| d1/Ls4 | 0.07 | 0.05 | 0.08 | 0.07 | 0.08 | 0.05 | 0.00 | 0.09 | 0.00 | 0.00 |
| d1/d2 | 2.33 | 2.50 | 2.30 | 4.00 | 3.13 | 2.00 | 0.00 | — | 0.00 | 0.00 |
| Yield rate | 100 | 100 | 95 | 98 | 100 | 96 | 90 | 94 | 88 | 86 |

In Table 1: --

*1 Rolled metal plates used are as follows:

M1 - Unidirectional rolled metal plate "TIX51AF" manufactured by Nippon Steel Corporation whose composition was Ti—5.5Al—1Fe, and thickness was 3.6 mm.

M2 - Unidirectional rolled metal plate "Ti-9" manufactured by Kobe Steel, Ltd. whose composition was Ti—4.5Al—2Mo—1.6V—0.5Fe—0.3Si—0.03C, and thickness was 4.0 mm.

M3 - Unidirectional rolled metal plate "SP700HM" manufactured by JFE Steel Corporation whose composition was Ti—4.5Al—3V—2Fe—2Mo, and thickness was 3.7 mm.

*2 Abbreviations in Order of processes are as follows:

cut: cutting out of the in-process face material from the rolled metal plate

CNC: cutting work by the use of a computer numerical controlled machine

I&O: an inclined surface was formed in each of the inner and outer surfaces.

I: an inclined surface was formed in the inner surface only.

O: an inclined surface was formed in the outer surface only press: pressure molding by the use of the drawing dies D1, D2

From the test results, it was confirmed that, according to the present invention, the face members can be manufactured at a high yield rate.

The present invention can be applied to various types of golf club heads such as iron-type, utility-type and patter-type aside from the wood-type golf club heads.

The invention claimed is:

1. A method for manufacturing a golf club head comprising:

a step of preparing a non-flat metal face member which comprises a main portion forming at least a part of a club face for striking a ball and a turnback extending backward from at least a part of the peripheral edge of the club face;

a step of preparing a metal head main body; and a step of welding the non-flat metal face member to the metal head main body, wherein the step of preparing said non-flat metal face member comprises:

a process (a) in which a rolled metal plate having a constant thickness is prepared;

a process (b) in which an in-process face material is cut out from the rolled metal plate after the process (a);

a process (c) in which the face member is prepared by forming the turnback by subjecting the in-process face material to a press working after the process (b);

a process (d) in which, in the outer surface of a corresponding-to-turnback region corresponding to the turnback, an inclined surface inclined to the inner surface of corresponding-to-turnback region towards the peripheral edge of corresponding-to-turnback region is formed by a cutting work carried out before the process (c) in a state of the in-process face material or in a state of the rolled metal plate so that the thickness of the corresponding-to-turnback region is continuously decreased towards the peripheral edge of the corresponding-to-turnback region.

2. The method for manufacturing a golf club head according to claim 1, wherein the turnback is formed along the entire circumference of the main portion.

3. The method for manufacturing a golf club head according to claim 2, wherein the turnback is made up of a crown-side turnback, a sole-side turnback, a toe-side turnback and a heel-side turnback, and the size of the turnback in a front to back direction has a maximum value in the crown-side turnback and sole-side turnback, and in the toe-side turnback and heel-side turnback, the size is not more than 50% of said maximum value.

4. The method for manufacturing a golf club head according to claim 1, 2 or 3, wherein the rolled metal plate having the constant thickness, has a strength anisotropy such that the maximum tensile strength measured in a certain direction is not less than 1.06 times the tensile strength measured in the normal direction to said certain direction, and in the process (b), the in-process face material is cut out from the rolled metal plate so that the angle between said certain direction and the up-and-down direction of the club face becomes not more than 45 degrees.

5. The method for manufacturing a golf club head according to claim 1, 2 or 3, wherein the rolled metal plate is made of a titanium alloy having alpha phase, or a stainless steel or a maraging steel.

6. The method for manufacturing a golf club head according to claim 1, wherein the volume of the golf club head is not less than 400 cc and not more than 470 cc.

7. The method for manufacturing a golf club head according to claim 1, wherein the mass of the golf club head is not less than 180 grams and not more than 210 grams.

8. The method for manufacturing a golf club head according to claim 1, wherein the maximum thickness (t2) of the turnback excluding a possible weld bead is not more than 2.50 mm and not less than 1.70 mm.

9. The method for manufacturing a golf club head according to claim 1, wherein the turnback is made up of a crown-side turnback, a sole-side turnback, a toe-side turnback and a heel-side turnback, and the size of the turnback in a front to back direction has a maximum value in the crown-side turnback and sole-side turnback, and in the intersecting part between the crown-side turnback and toe-side turnback and also in the intersecting part between the crown-side turnback and heel-side turnback, the size is not more than 50% of said maximum value.

10. The method for manufacturing a golf club head according to claim 1, wherein the size of the turnback in the front-back direction is not less than 3.0 mm and not more than 13.0 mm.

11. The method for manufacturing a golf club head according to claim 1, wherein the process (d) is carried out in the state of the rolled metal plate after the process (a) and before the process (b).

12. The method for manufacturing a golf club head according to claim 1, wherein by the cutting work in the process (d), each of the inner surface and outer surface of the corresponding-to-turnback region is provided with the inclined surface.

13. The method for manufacturing a golf club head according to claim 1, wherein the thickness (t4) of the peripheral edge portion of the corresponding-to-turnback region is not less than 0.80 mm and not more than 1.60 mm.

14. The method for manufacturing a golf club head according to claim 1, wherein the quotient (t2−t4)/(Ls) of the difference (t2−t4) between the thickness (t2) of the corresponding-to-turnback region at its the base and the thickness (t4) of the corresponding-to-turnback region at its peripheral edge, divided by the width (Ls) of the corresponding-to-turnback region is not less than 0.03 and not more than 0.35.

15. The method for manufacturing a golf club head according to claim 1, wherein the cutting depth (d1) of the inclined surface formed on the outer surface of the corresponding-to-turnback region is not less than 0.15 mm and not more than 0.50 mm.

16. The method for manufacturing a golf club head according to claim 1, wherein the ratio (d1)/(Ls) of the cutting depth (d1) of the inclined surface formed on the outer surface of the corresponding-to-turnback region to the width (Ls) of the corresponding-to-turnback region is not less than 0.015 and less than 0.090.

17. The method for manufacturing a golf club head according to claim 1, wherein the cutting depth of the inclined surface formed on the inner surface of the corresponding-to-turnback region is not less than 0.10 mm and not more than 0.30 mm.

18. The method for manufacturing a golf club head according to claim 1, wherein the cutting depth (d1) of the inclined surface formed on the outer surface of the corresponding-to-turnback region is not less than 0.15 mm and not more than 0.50 mm, the cutting depth (d2) of the inclined surface formed on the inner surface of the corresponding-to-turnback region is not less than 0.10 mm and not more than 0.30 mm, and the ratio (d1)/(d2) is not less than 2.0 and not more than 5.0.

19. The method for manufacturing a golf club head according to claim 1, wherein the rolled metal plate is a unidirectionally rolled metal plate.

20. The method for manufacturing a golf club head according to claim 1, wherein the press working in the process (c) is carried out by the use of a pair of drawing dies and, wherein the positive drawing die is provided with a non-flat molding surface corresponding to the surface of the thick central region, thin surrounding region and transitional region of the in-process face material.

21. The method for manufacturing a golf club head according to claim 1, wherein the step of preparing said non-flat metal face member further comprises:

a process for giving a face bulge and/or a face roll to the main portion of the face member which is incorporated in the press working of the process (c).

* * * * *